United States Patent [19]

Bauer et al.

[11] Patent Number: 4,609,296

[45] Date of Patent: Sep. 2, 1986

[54] CHARACTER-CARRYING DISC FOR A PRINTING MACHINE

[75] Inventors: Eric Bauer, Neuchatel; Blaise Moulin, Corcelles, both of Switzerland

[73] Assignee: Caracteres S.A., Neuchantel, Switzerland

[21] Appl. No.: 732,188

[22] Filed: May 9, 1985

[30] Foreign Application Priority Data

May 22, 1984 [CH] Switzerland ..... 2519/84

[51] Int. Cl.[4] ..... B41J 1/30

[52] U.S. Cl. ..... 400/175; 400/144.2; 403/372

[58] Field of Search ..... 400/144.2, 144.3, 174, 400/175; 403/365, 372

[56] References Cited

U.S. PATENT DOCUMENTS 3,878,929 4/1975 Orlens et al. ..... 400/175

4,403,876 9/1983 Vought .

FOREIGN PATENT DOCUMENTS 2518207 11/1976 Fed. Rep. of Germany ..... 400/175

*Primary Examiner*—William Pieprz

*Assistant Examiner*—John A. Weresh

*Attorney, Agent, or Firm*—Silverman, Cass, Singer & Winburn, Ltd.

[57] ABSTRACT

A character-carrying disc for a printing machine has a central hole surmounted by a circular portion which is situated out of the plane of a body of the disc and supported at a distance from the body of the disc by two diametrically opposed pillars. This circular portion is provided with two diametrically opposed ears enabling the disc to be gripped. The circular portion of the disc is provided with two small tongues which are elastically deformable and are directed axially, with free ends of the tongues being movable in two openings provided in the body of the disc. The small tongues are adapted to press resiliently on the shaft of the printing machine on which the disc is mounted for the purpose of retaining the disc in place on this shaft.

2 Claims, 4 Drawing Figures

CHARACTER-CARRYING DISC FOR A PRINTING MACHINE

BACKGROUND OF THE INVENTION (a) Field of the Invention

This invention relates to a character-carrying disc for a printing machine provided, at its center, with a hollow protrusion formed integrally in one piece with the body of the disc and adapted to be engaged on the end of a shaft of the printing machine on which the disc is mounted.

(b) Description of the Prior Art

Character-carrying discs for printing machines and having such a central protrusion are known.

SUMMARY OF THE INVENTION

The object of the present invention is to simplify the manufacture of such discs.

This object is achieved by the fact that in a disc according to the invention said central protrusion comprises a bottom connected to the body of the disc by at least two pillars between which are arranged at least two resiliently deformable small tongues with free ends which are situated in the vicinity of the body of the disc, these small tongues being adapted to press resiliently on the shaft of the printing machine on which the disc is mounted.

The various features of the invention will be apparent from the following description, drawings and claims, the scope of the invention not being limited to the drawings themselves as the drawings are only for the purpose of illustrating ways in which the principles of the invention can be applied. Other embodiments of the invention utilising the same or equivalent principles may be used and structural changes may be made as desired by those skilled in the art without departing from the present invention and the purview of the appended claims.

DESCRIPTION OF THE PREFERRED EMBODIMENTS

The disc illustrated is moulded from plastics material and has a body designated by reference 1. It is provided with resiliently deformable radial arms 1*a* carrying, at their ends, characters designated by 1*b*. The disc is provided with a central hole 2 opposite which is situated a circular portion 1*c*, disposed parallel to the plane of the disc, which is maintained at a distance from the disc by two pillars 1*d*. This portion 1*c* is provided with two diagrammatically opposed ears 1*e* enabling the disc to be gripped whilst putting it on the shaft of the printing machine and whilst withdrawing it therefrom.

The protruding part 1*c* of the disc is provided with two small tongues 1*f* which are resiliently deformable, which are disposed parallel to the axis of the disc, and which extend from the base of the ears 1*e*. These small tongues 1*f* are intended, when the disc is engaged on the shaft of the printing machine, to press radially against this shaft for the purpose of retaining the disc in place on the shaft.

The body of the disc is provided with two rectangular openings 3 communicating with a central hole 2. The ends of the small tongues 1*f* are located in the openings 3 which permit radial displacement of these tongues.

Figure 1:
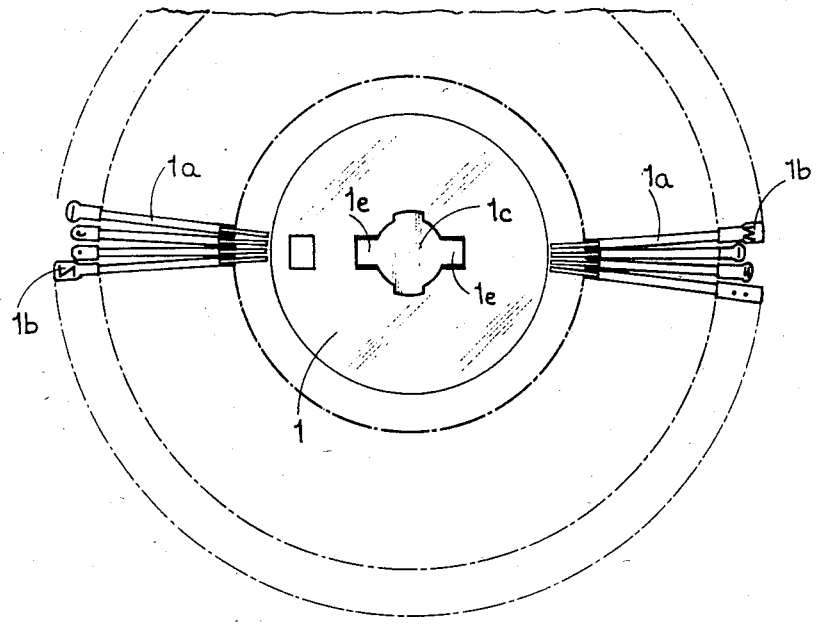
FIG. 1 is a face view of a portion of a character-carrying disc for a printing machine, for example a typewriter.
Figure 2:
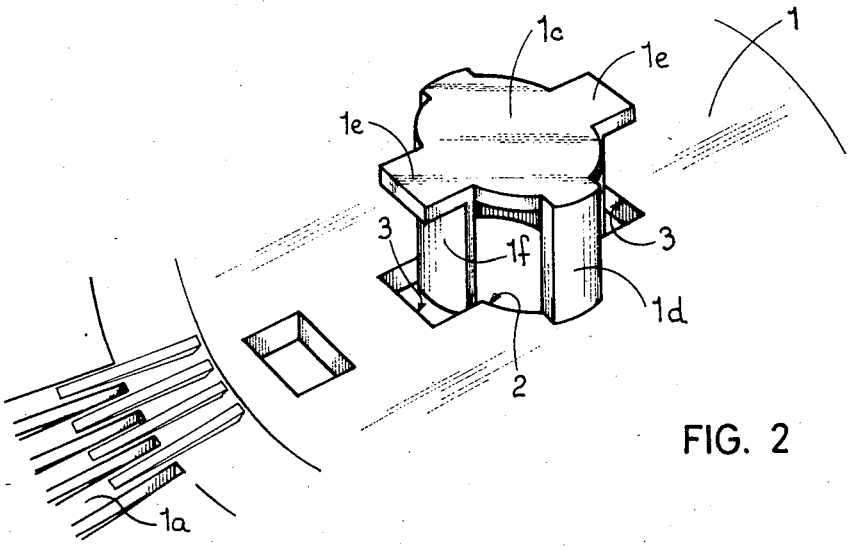
FIG. 2 is a perspective view of a portion of the disc, to a larger scale.
Figure 3:
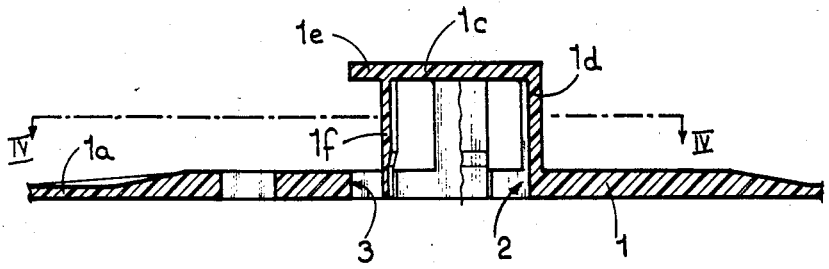
FIG. 3 is an axial sectional view of a part of the disc, along the line III—III of FIG. 4.
Figure 4:
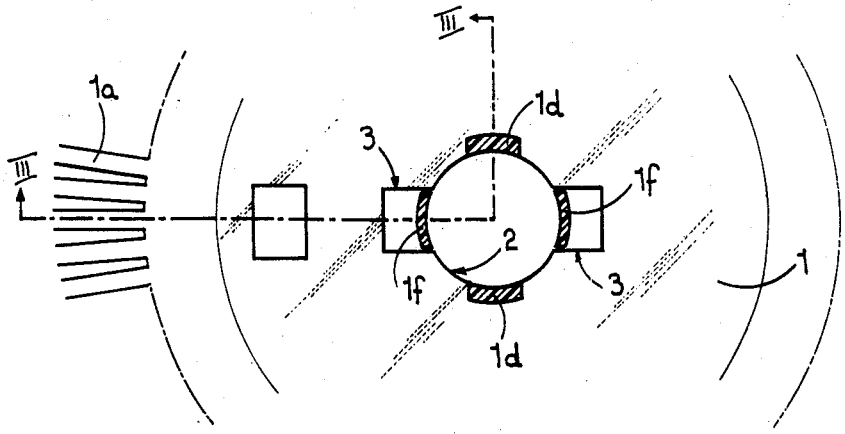
FIG. 4 is a sectional view along the line IV—IV of FIG. 3.

The disc, all the elements of which are made integrally in one piece with the body 1, is manufactured by moulding without the existence of the protruding portion 1*c* and of the elements which are depending therefrom giving rise to difficulties since, as shown particularly by FIG. 3, the disc presents no "re-entrant" portion so that it can be extracted from the mould by a mere axial withdrawal. Moreover, the mould is simple in its conception, even if it must be made with a high degree of precision.

It is to be noted that, in the example as illustrated, the pillars 1*d* sustaining the protrusion portion 1*c* of the disc are two in number, and are diametrically opposed, as also are the small tongues 1*f*. One can provide modified designs where the pillars 1*d* are three in number, or even four, in which case they will be arranged at 120° or 90° with respect to one another. In this case the elastic small tongues 1*f* will also be three or four in number, respectively, and positioned individually between the pillars.

We claim:

1. A printing wheel disc having a body and a central hole in the body within which a drive shaft of a printing machine is received for mounting of the disc thereon, said body having a hollow central protrusion unitary therewith and capable of being engaged on the end of the drive shaft, said central protrusion comprising an outer portion generally coplanar with said body, rigid upstanding wall means normal to said body and connecting same to said outer portion, resilient depending tongue means proximate the outer portion and extending in a direction generally parallel to the axis of the central hole and including at least a pair of resilient tongue members disposed symmetrically about the central hole and having free ends terminating in the vicinity of said body, said tongue members capable of pressing resiliently on said drive shaft when the disc is translated in an axial direction toward said drive shaft and said outer portion is formed as a planar formation extending over the central hole and having at least a pair of outwardly extending rigid radial ears providing a purchase for grasping said central protrusion to enable engagement and disengagement of said disc onto the drive shaft.

2. A printing wheel disc having a body and a central hole in the body within which a drive shaft of a printing machine is received for mounting of the disc thereon, said body having a hollow central protrusion unitary therewith and capable of being engaged on the end of the drive shaft, said central protrusion comprising an outer portion generally coplanar with said body, rigid upstanding wall means normal to said body and connecting same to said outer portion, resilient depending tongue means proximate the outer portion and extending in a direction generally parallel to the axis of the central hole and including at least a pair of resilient tongue members disposed symmetrically about the central hole and having free ends terminating in the vicinity of said body, said tongue members capable of pressing resiliently on said drive shaft when the disc is translated in an axial direction toward said drive shaft and said outer portion is formed as a planar formation disposed over said central hole and said rigid wall means comprise at least a pair of pillars connecting said planar formation to said body, said planar formation having a pair of outwardly extending rigid ears disposed between said pillars said ears being capable of providing a purchase for grasping said disc for the purpose of engaging and disengaging said disc onto said drive shaft of the printing machine.

* * * * *